US011436963B2

(12) United States Patent
Oh et al.

(10) Patent No.: US 11,436,963 B2
(45) Date of Patent: Sep. 6, 2022

(54) LEVEL SHIFT CIRCUIT AND SOURCE DRIVER INCLUDING THE SAME

(71) Applicant: Silicon Works Co., Ltd., Daejeon (KR)

(72) Inventors: Goon Seok Oh, Daejeon (KR); Hyo Joong Kim, Daejeon (KR)

(73) Assignee: Silicon Works Co., Ltd, Daejeon (KR)

( * ) Notice: Subject to any disclaimer, the term of this patent is extended or adjusted under 35 U.S.C. 154(b) by 0 days.

(21) Appl. No.: 17/204,673

(22) Filed: Mar. 17, 2021

(65) Prior Publication Data

US 2021/0295757 A1 Sep. 23, 2021

(30) Foreign Application Priority Data

Mar. 18, 2020 (KR) ..... 10-2020-0033122

(51) Int. Cl.
*G09G 3/20* (2006.01)
*G09G 3/36* (2006.01)
*G09G 3/3275* (2016.01)

(52) U.S. Cl.
CPC ..... *G09G 3/20* (2013.01); *G09G 3/3275* (2013.01); *G09G 3/3685* (2013.01); *G09G 2310/027* (2013.01); *G09G 2310/0289* (2013.01); *G09G 2310/0297* (2013.01)

(58) Field of Classification Search
CPC ..... G09G 2310/0289; G09G 3/20; G09G 3/3275; G09G 3/3685; G09G 2310/027; G09G 2310/0297
See application file for complete search history.

(56) References Cited

U.S. PATENT DOCUMENTS 6,518,708 B2 * 2/2003 Aso ..... G09G 3/3614 315/169.1
6,980,189 B2 * 12/2005 Maruoka ..... G09G 3/20 345/94
7,209,103 B2 * 4/2007 Maeda ..... G09G 5/006 345/87
7,636,487 B2 * 12/2009 Lee ..... G09G 3/2044 358/463
7,978,162 B2 * 7/2011 Maruoka ..... G09G 3/20 345/87
8,456,463 B2 * 6/2013 Bandyopadhyay .. G09G 3/3233 345/212
8,564,518 B2 * 10/2013 Nakahata ..... G09G 3/3648 345/89

(Continued)

FOREIGN PATENT DOCUMENTS

KR 2013-0137452 B1 12/2013
KR 2017-0080234 A 7/2017
KR 2018-0082952 A 7/2018

*Primary Examiner* — Michael J Jansen, II
(74) *Attorney, Agent, or Firm* — Polsinelli PC

(57) ABSTRACT

The present disclosure discloses a source driver including a level shift circuit. The source driver may include a level shift circuit outputting second and third logic signals by shifting a level of a first logic signal and a multiplexer transferring a first or second source signal to a first or second pad in response to the second and third logic signals. The level shift circuit may include a first level shifter outputting first and second input signals by shifting the level of the first logic signal, a second level shifter outputting third and fourth input signals by shifting the level of the first logic signal, and an output circuit outputting the second logic signal in response to the second and fourth input signals and outputting the third logic signal in response to the first and third input signals.

18 Claims, 4 Drawing Sheets

(56) References Cited

U.S. PATENT DOCUMENTS 8,723,585 B2 * 5/2014 Qin ..... H03K 19/017527 326/62
9,143,090 B2 * 9/2015 Seo ..... G06F 1/26
9,489,911 B2 * 11/2016 Aoki ..... G09G 3/3685
10,083,664 B1 * 9/2018 Du ..... G09G 3/3655
10,089,945 B2 * 10/2018 Kim ..... G09G 3/3614
10,431,175 B2 * 10/2019 Choi ..... G09G 3/3677
10,741,137 B2 * 8/2020 Bai ..... G09G 3/3688
10,984,740 B2 * 4/2021 Kim ..... G09G 3/3688
2002/0074948 A1 * 6/2002 Aso ..... G09G 3/3614 315/169.3
2002/0186192 A1 * 12/2002 Maruoka ..... G09G 3/20 345/87
2003/0156086 A1 * 8/2003 Maeda ..... G06F 3/14 345/89
2006/0050045 A1 * 3/2006 Maruoka ..... G09G 3/3614 345/99
2008/0079708 A1 * 4/2008 Bandyopadhyay .. G09G 3/3233 345/212
2009/0015535 A1 * 1/2009 Jeong ..... G09G 3/3685 345/98
2012/0139893 A1 * 6/2012 Chung ..... G09G 3/3688 345/212
2013/0162618 A1 * 6/2013 Seo ..... G06F 1/26 345/212
2013/0249617 A1 * 9/2013 Qin ..... G09G 3/3677 327/319
2013/0300726 A1 * 11/2013 Son ..... G09G 5/00 345/212
2014/0375536 A1 * 12/2014 Kim ..... G09G 3/3614 345/94
2017/0249913 A1 * 8/2017 Kim ..... G09G 3/3614
2017/0330525 A1 * 11/2017 Choi ..... G09G 3/3674
2018/0122291 A1 * 5/2018 Kim ..... G09G 3/3696
2018/0336857 A1 * 11/2018 Shi ..... G11C 19/287
2021/0295757 A1 * 9/2021 Oh ..... G09G 3/20

* cited by examiner

LEVEL SHIFT CIRCUIT AND SOURCE DRIVER INCLUDING THE SAME

BACKGROUND

1. Technical Field

The present disclosure relates to a display device, and more particularly, to a level shift circuit and a source driver including the same.

2. Related Art

In general, a source driver of a display device is required to have low resistance in its source output stage in order to display an image having high resolution at a high speed. To this end, a known source driver includes an output circuit using a multiplexer consisting of a high voltage element operating in a high voltage range.

The multiplexer consisting of the high voltage element becomes a burden from the viewpoint of a chip size of the source driver. For this reason, the source driver maintains the source output stage at low resistance by adopting a multiplexer consisting of middle voltage elements operating in a middle voltage range in order to reduce the chip size.

The multiplexer requires a logic signal swinging in a high voltage range in order to reduce resistance of the source output stage. The logic signal swinging in the high voltage range may be provided to the multiplexer using a level shift circuit using a high voltage element.

Furthermore, a source signal output from the multiplexer to the source output stage also swings in the high voltage range. Accordingly, the source signal may be output using an input and output clamping circuit which uses a high voltage element operating in the high voltage range and clamps the swing range of the source signal to the high voltage range.

Accordingly, a general source driver has a problem in that the chip size is increased because a circuit is configured using the high voltage element.

SUMMARY

Various embodiments are directed to providing a level shift circuit capable of processing a logic signal having a high voltage range by using only a middle voltage element operating in a middle voltage range, and a source driver including the same.

In an embodiment, a source driver may include a level shift circuit configured to output a second logic signal and a third logic signal by shifting a level of a first logic signal and a multiplexer configured to transfer a first source signal or a second source signal to a first pad or a second pad in response to the second logic signal and the third logic signal. The level shift circuit may include a first level shifter configured to output a first input signal and a second input signal by shifting the level of the first logic signal, a second level shifter configured to output a third input signal and a fourth input signal by shifting the level of the first logic signal, and an output circuit configured to output the second logic signal in response to the second input signal and the fourth input signal and output the third logic signal in response to the first input signal and the third input signal.

In an embodiment, a level shift circuit may include a first level shifter configured to output a first input signal and a second input signal by shifting a level of a first logic signal, a second level shifter configured to output a third input signal and a fourth input signal by shifting the level of the first logic signal, and an output circuit configured to output a second logic signal in response to the second input signal and the fourth input signal and output a third logic signal in response to the first input signal and the third input signal. The output circuit may output the second and third logic signals each having a third voltage range including a first voltage range and a second voltage range by using pull-up elements operating in the first voltage range and pull-down elements operating in the second voltage range.

According to embodiments, a chip size can be reduced because a circuit capable of processing a logic signal having a high voltage range is configured using only a middle voltage element operating in a middle voltage range.

Furthermore, a product cost can be reduced because a high voltage mask layer can be omitted in a process.

DETAILED DESCRIPTION

Embodiments are intended to provide a level shift circuit capable of processing a signal having a high voltage range by using only middle voltage elements operating in a middle voltage range, and a source driver including the same.

In embodiments, the middle voltage range may be defined as a swing range of a first source signal output by a positive amplifier or may be defined as a swing range of a second source signal output by a negative amplifier. In this case, the swing range of the first source signal may be named a first voltage range, and the swing range of the second source signal may be named a second voltage range.

In embodiments, the high voltage range may be defined as a voltage range from the highest voltage of the first voltage range to the lowest voltage of the second voltage range. In this case, the high voltage range may be named a third voltage range.

In embodiments, the middle voltage element may be defined as an element which operates in the first voltage range or the second voltage range.

Figure 1:
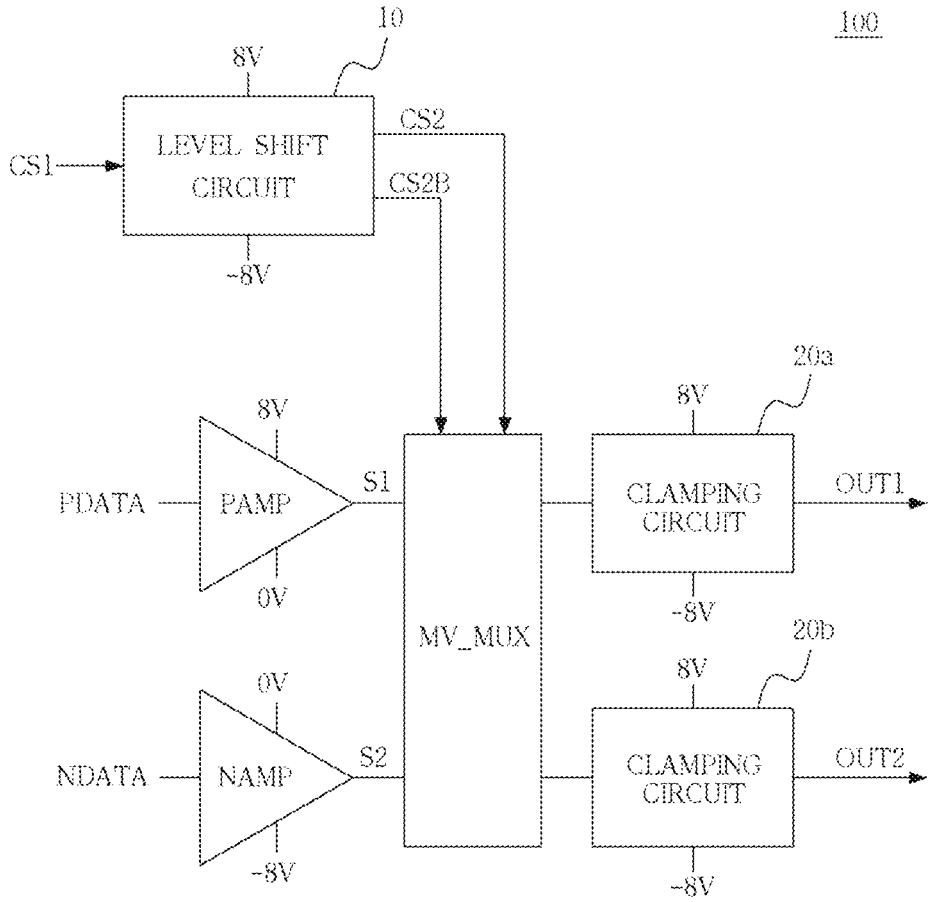
FIG. 1 is a block diagram of a source driver according to an embodiment.

FIG. 1 is a block diagram of a source driver 100 according to an embodiment. In this case, only an example in which a pair of source signals S1 and S2 is provided to a display panel (not illustrated) through a pair of channels is illustrated, but this is for convenience of description and the present disclosure is not limited thereto.

Referring to FIG. 1, the source driver 100 may include a positive amplifier PAMP, a negative amplifier NAMP, a multiplexer MV_MUX, a level shift circuit 10, and clamping circuits 20*a* and 20*b*.

The positive amplifier PAMP may amplify positive data PDATA and output the amplified data as a first source signal S1. The negative amplifier NAMP may amplify negative data NDATA and output the amplified data as a second source signal S2. In this case, the positive amplifier PAMP may operate in the first voltage range. The negative amplifier NAMP may operate in the second voltage range.

Although not illustrated, the source driver 100 may further include a latch circuit that latches image data and a digital-to-analog converter that converts the image data into the positive data PDATA and the negative data NDATA by using grayscale voltages.

The multiplexer MV_MUX may output the first source signal S1 as a first output signal OUT1, and may output the second source signal S2 as a second output signal OUT2. Alternatively, the multiplexer MV_MUX may output the first source signal S1 as the second output signal OUT2, and may output the second source signal S2 as the first output signal OUT1.

The multiplexer MV_MUX may output the first source signal S1 and the second source signal S2 as the first output signal OUT1 and the second output signal OUT2, respectively, or the first source signal S1 and the second source signal S2 as the second output signal OUT2 and the first output signal OUT1, respectively, based on logic levels of logic signals CS2 and CS2B provided by the level shift circuit 10.

The multiplexer MV_MUX may be configured using middle voltage elements operating in the first voltage range or middle voltage elements operating in the second voltage range. For example, the multiplexer MV_MUX may include a first positive switch circuit that transfers the first source signal S1 as the first output signal OUT1, a second positive switch circuit that transfers the first source signal S1 as the second output signal OUT2, a first negative switch circuit that transfers the second source signal S2 as the second output signal OUT2, and a second negative switch circuit that transfers the second source signal S2 as the first output signal OUT1.

Furthermore, each of the switch circuits of the multiplexer MV_MUX may include switches which operate in the middle voltage range and are coupled in series. Each of the switches may be turned on or off in response to the logic signals CS2 and CS2B.

The level shift circuit 10 may output a second logic signal CS2 and a third logic signal CS2B to the multiplexer MV_MUX by shifting a level of a first logic signal CS1 having a low voltage level. In this case, the third logic signal CS2B may be an inverted signal of the second logic signal CS2.

The clamping circuits 20*a* and 20*b* may clamp the first output signal OUT1 and the second output signal OUT2 to the first voltage range or the second voltage range. For example, each of the clamping circuits 20*a* and 20*b* may include diodes that are coupled in series. Each of the diodes may be configured using elements operating in the middle voltage range.

Figure 2:
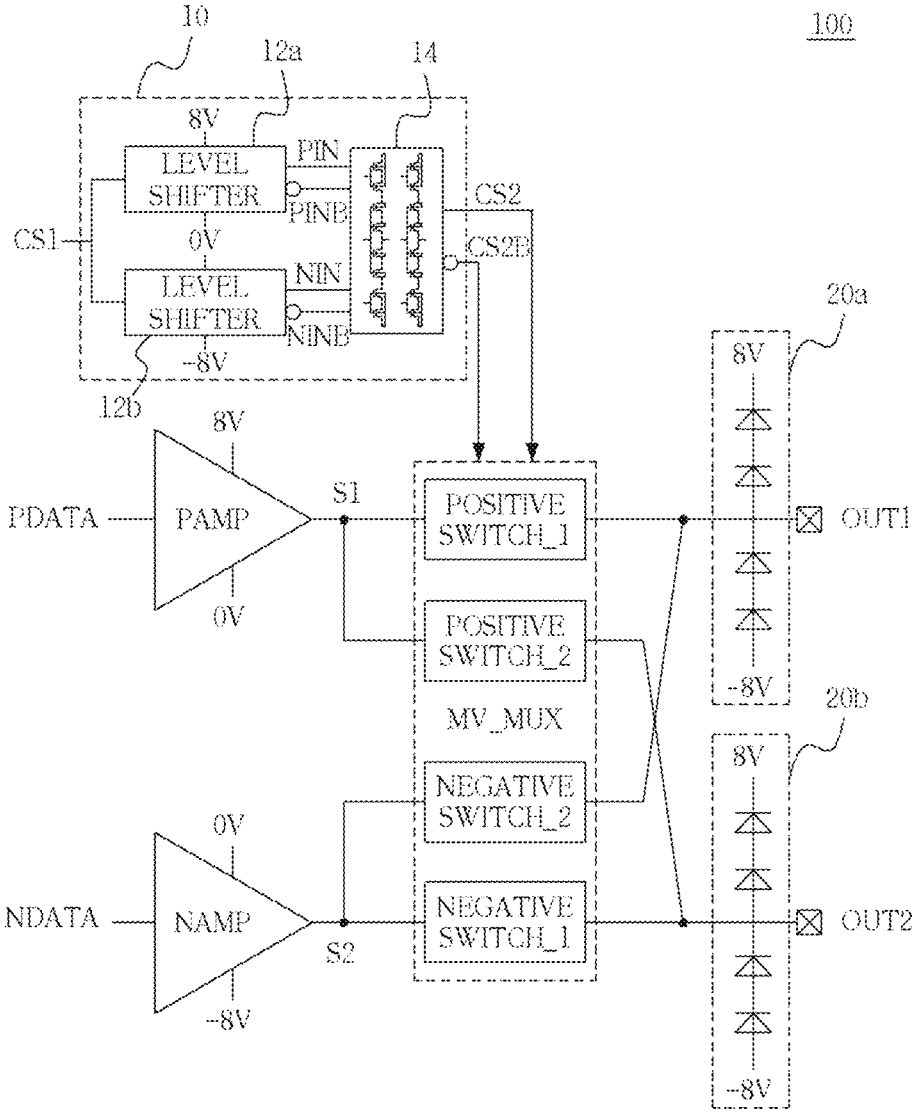
FIG. 2 illustrates the source driver including a level shift circuit according to an embodiment.

FIG. 2 illustrates the source driver 100 including the level shift circuit 10 according to an embodiment.

Referring to FIG. 2, the level shift circuit 10 may include a first level shifter 12*a*, a second level shifter 12*b* and an output circuit 14.

The first level shifter 12*a* may output a first input signal PIN and a second input signal PINB by shifting a level of the first logic signal CS1. The second input signal PINB may be an inverted signal of the first input signal PIN. The first level shifter may operate in the first voltage range, that is, the swing range of the first source signal S1.

The second level shifter 12*b* may output a third input signal NIN and a fourth input signal NINB by shifting a level of the first logic signal CS1. The fourth input signal NINB may be an inverted signal of the third input signal NIN. The second level shifter 12*b* may operate in the second voltage range, that is, the swing range of the second source signal.

The output circuit 14 may output the second logic signal in response to the second input signal PINB and the fourth input signal NINB, and may output the third logic signal CS2B in response to the first input signal PIN and the third input signal NIN.

The output circuit 14 may include pull-up elements operating in the first voltage range, and may include pull-down elements operating in the second voltage range. Furthermore, the output circuit 14 may output the second logic signal CS2 and the third logic signal CS2B which may swing in the third voltage range from the highest voltage of the first voltage range to the lowest voltage of the second voltage range.

The positive amplifier PAMP may amplify the positive data PDATA and output the amplified data as the first source signal S1. The negative amplifier NAMP may amplify the negative data NDATA and output the amplified data as the second source signal S2. In this case, the positive amplifier PAMP may operate in the first voltage range, and the negative amplifier NAMP may operate in the second voltage range.

The multiplexer MV_MUX may output the first source signal S1 and the second source signal S2 as the first output signal OUT1 and the second output signal OUT2, respectively, or the first source signal S1 and the second source signal S2 as the second output signal OUT2 and the first output signal OUT1, respectively, based on logic levels of the second logic signal CS2 and the third logic signal CS2B.

The multiplexer MV_MUX may include the first positive switch circuit, the second positive switch circuit, the first negative switch circuit, and the second negative switch circuit. The first positive switch circuit may transfer the first source signal S1 to a first pad as the first output signal OUT1. The second positive switch circuit may transfer the first source signal S1 to a second pad as the second output signal OUT2. The first negative switch circuit may transfer the second source signal S2 to the second pad as the second output signal OUT2. The second negative switch circuit may transfer the second source signal S2 to the first pad as the first output signal OUT1.

Each of the first positive switch circuit, the second positive switch circuit, the first negative switch circuit and the second negative switch circuit may include the switches which operate in the middle voltage range and are coupled in series. Each of the switches may be configured as at least one NMOS transistor or PMOS transistor.

The first clamping circuit 20*a* may be coupled between the multiplexer MV_MUX and the first pad, and may clamp, to the first voltage range or the second voltage range, the first output signal OUT1 output to the first pad.

The second clamping circuit 20*b* may be coupled between the multiplexer MV_MUX and the second pad, and may clamp, to the first voltage range or the second voltage range, the second output signal OUT2 output to the second pad.

The first clamping circuit 20*a* and the second clamping circuit 20*b* may include first and second diodes coupled in series and third and fourth diodes coupled in series.

The first diodes and the second diodes may clamp the first output signal OUT1 or the second output signal OUT2 to the first voltage range. The third diodes and the fourth diodes may clamp the first output signal OUT1 or the second output signal OUT2 to the second voltage range.

Figure 3:
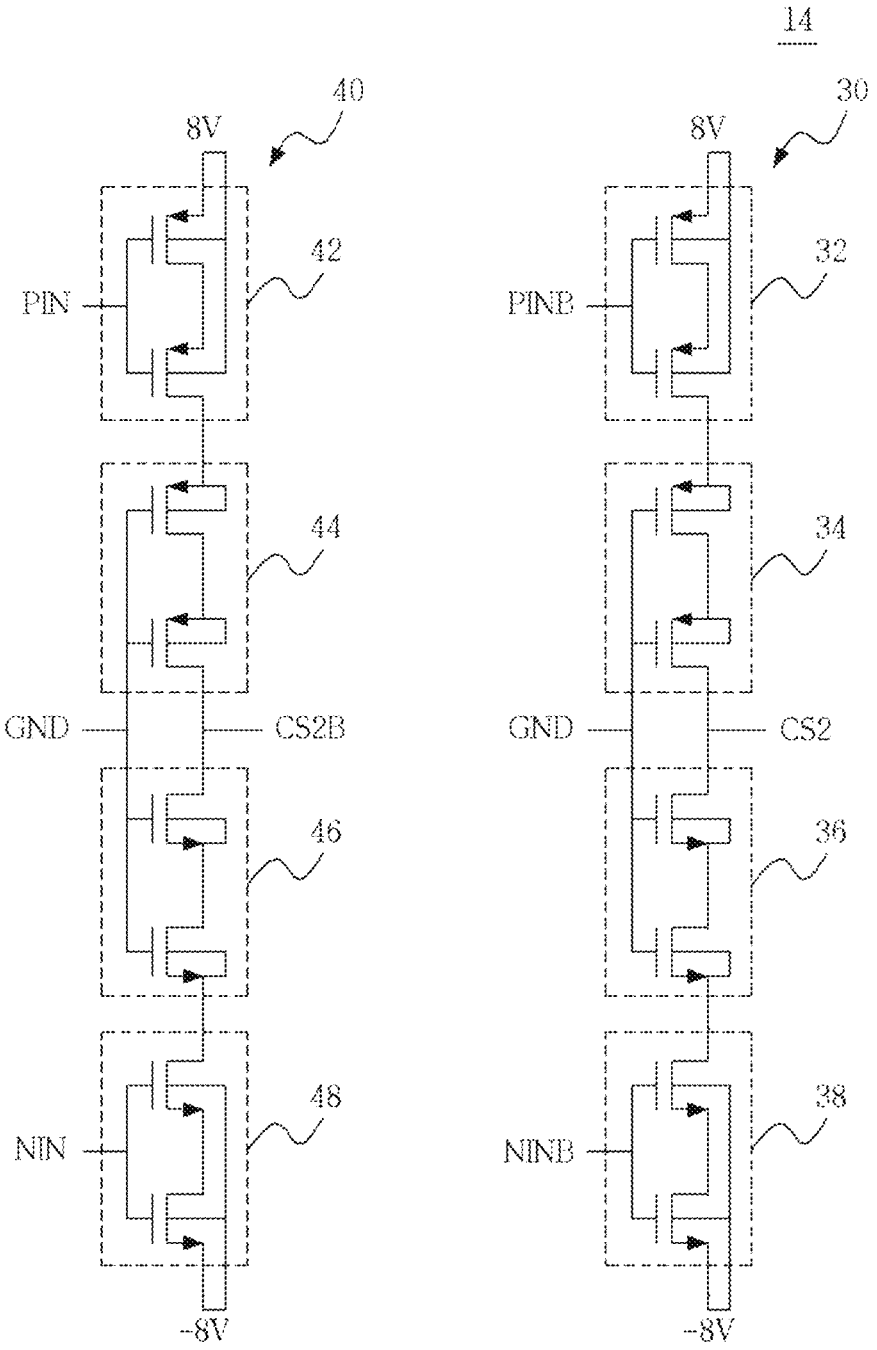
FIG. 3 illustrates an output circuit of the level shift circuit according to an embodiment.

FIG. 3 illustrates the output circuit 14 of the level shift circuit 10 according to an embodiment.

Referring to FIG. 3, the output circuit 14 of the level shift circuit 10 may include a first output circuit 30 that outputs the second logic signal CS2 by pull-up or pull-down operating based on logic levels of the second input signal PINB and the fourth input signal NINB, and may include a second output circuit 40 that outputs the third logic signal CS2B by pull-up or pull-down operating based on logic levels of the first input signal PIN and the third input signal NIN.

The first output circuit 30 may include a first pull-up circuit 32 configured to pull-up drive the second logic signal CS2 in response to the second input signal PINB, a first voltage division circuit 34 coupled between the first pull-up circuit 32 and a first output stage from which the second logic signal CS2 is output, a first pull-down circuit 38 configured to pull-down drive the second logic signal CS2 in response to the fourth input signal NINB, and a second voltage division circuit 36 coupled between the first pull-down circuit 38 and the first output stage.

The first pull-up circuit 32 may include first and second PMOS elements coupled in series. The first and second PMOS elements may have source terminal and body terminal coupled in common, and may have gate terminals to which the second input signal PINB is applied. The first pull-up circuit 32 may operate in the first voltage range.

The first pull-down circuit 38 may include first and second NMOS elements coupled in series. The first and second NMOS elements may have source terminal and body terminal coupled in common, and may have gate terminals to which the fourth input signal NINB is applied. The first pull-down circuit 38 may operate in the second voltage range.

The first voltage division circuit 34 may include third and fourth PMOS elements coupled in series. Each of the third and fourth PMOS elements may have a source terminal and a body terminal coupled in common, and may have a gate terminal to which a ground voltage GND is applied. The first voltage division circuit 34 may operate in the first voltage range or the second voltage range based on logic levels of the second input signal PINB and the fourth input signal NINB.

The second voltage division circuit 36 may include third and fourth NMOS elements coupled in series. Each of the third and fourth NMOS elements may have a source terminal and a body terminal coupled in common, and may have a gate terminal to which the ground voltage GND is applied. The second voltage division circuit 36 may operate in the first voltage range or the second voltage range based on logic levels of the second input signal PINB and the fourth input signal NINB.

The second output circuit 40 may include a second pull-up circuit 42 configured to pull-up drive the third logic signal CS2B in response to the first input signal PIN, a third voltage division circuit 44 coupled between the second pull-up circuit 42 and a second output stage from which the third logic signal CS2B is output, a second pull-down circuit 48 configured to pull-down drive the third logic signal CS2B in response to the third input signal NIN, and a fourth voltage division circuit 46 coupled between the second pull-down circuit 48 and the second output stage.

The second pull-up circuit 42 may include first and second PMOS elements coupled in series. The first and second PMOS elements may have source terminal and body terminal coupled in common, and may have gate terminals to which the first input signal PIN is applied. The second pull-up circuit 42 may operate in the first voltage range.

The second pull-down circuit 48 may include first and second NMOS elements coupled in series. The first and second NMOS elements may have a source terminal and a body terminal coupled in common, and may have gate terminals to which the third input signal NIN is applied. The second pull-down circuit 48 may operate in the second voltage range.

The third voltage division circuit 44 may include third and fourth PMOS elements coupled in series. Each of the third and fourth PMOS elements may have a source terminal and a body terminal coupled in common, and may have a gate terminal to which the ground voltage GDN is applied. The third voltage division circuit 44 may operate in the first voltage range or the second voltage range based on logic levels of the first input signal PIN and the third input signal NIN.

The fourth voltage division circuit 46 may include third and fourth NMOS elements coupled in series. Each of the third and fourth NMOS elements may have a source and a body coupled in common, and may have a gate terminal to which the ground voltage GDN is applied. The fourth voltage division circuit 46 may operate in the first voltage range or the second voltage range based on logic levels of the first input signal PIN and the third input signal NIN.

Figure 4:
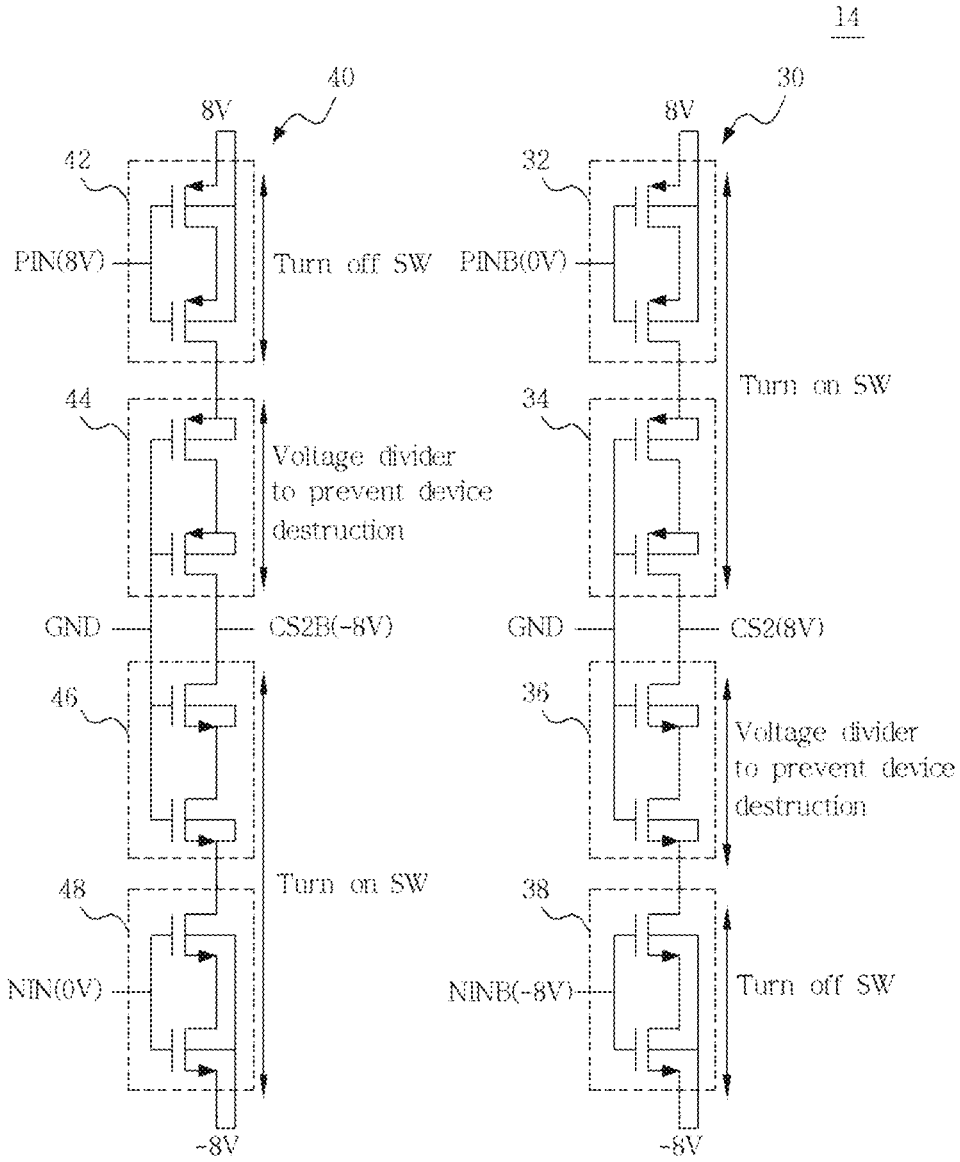
FIG. 4 is a diagram illustrating an operation of the level shift circuit according to an embodiment.

FIG. 4 is a diagram illustrating an operation of the level shift circuit according to an embodiment.

FIG. 4 illustrates an operation of the first output circuit 30 pull-up driving the second logic signal CS2 and an operation of the second output circuit 40 pull-down driving the third logic signal CS2B. In this case, the second logic signal CS2 may have the highest voltage level of the first voltage range, and the third logic signal CS2B may have the lowest voltage level of the second voltage range.

The operation of the first output circuit 30 is described as follows. The first pull-up circuit 32 may be turned on in response to the second input signal PINB. The first voltage division circuit 34 may be turned on in response to the ground voltage. Furthermore, the first pull-down circuit 38 of the first output circuit 30 may be turned off, and the second voltage division circuit 36 thereof may be turned off in response to the ground voltage. In this case, the second voltage division circuit 36 can prevent the middle voltage elements from being destructed due to the second logic signal CS2 having the highest voltage level of the first voltage range.

An operation of the second output circuit 40 is described as follows. The second pull-up circuit 42 may be turned off in response to the first input signal PIN. The third voltage division circuit 44 may be turned off in response to the ground voltage. Furthermore, the second pull-down circuit 48 of the second output circuit 40 may be turned on, and the fourth voltage division circuit 46 thereof may be turned on in response to the ground voltage. In this case, the third voltage division circuit 44 can prevent the middle voltage elements from being destructed due to the third logic signal CS2B having the lowest voltage level of the second voltage range.

In the embodiments illustrated in FIGS. 1 to 4, the first voltage range is illustrated as 8 V to 0 V, the second voltage range is illustrated as 0 V to −8 V, and the third voltage range is illustrated as 8 V to −8 V, but the present disclosure is not limited thereto.

As described above, the embodiments can reduce the chip size because a circuit capable of processing a signal having a high voltage range can be configured using only the middle voltage elements operating in the middle voltage range. Furthermore, the embodiments can reduce a product cost because a high voltage mask layer can be omitted in a process.

What is claimed is:

1. A source driver comprising:

a level shift circuit configured to output a second logic signal and a third logic signal by shifting a level of a first logic signal; and a multiplexer configured to transfer a first source signal or a second source signal to a first pad or a second pad in response to the second logic signal and the third logic signal, wherein the level shift circuit comprises:

a first level shifter configured to output a first input signal and a second input signal by shifting the level of the first logic signal;

a second level shifter configured to output a third input signal and a fourth input signal by shifting the level of the first logic signal; and an output circuit configured to output the second logic signal in response to the second input signal and the fourth input signal and output the third logic signal in response to the first input signal and the third input signal, wherein the first level shifter operates in a first voltage range, the second level shifter operates in the second voltage range, and the output circuit further configured to output the second logic signal equivalent to the highest voltage input to the first level shifter and the third logic signal equivalent to the lowest voltages input to the second level shifter, and wherein the first output circuit comprises:

a first pull-up circuit configured to pull-up drive the second logic signal in response to the second input signal;

a first voltage division circuit coupled between the first pull-up circuit and a first output stage from which the second logic signal is output;

a first pull-down circuit configured to pull-down drive the second logic signal in response to the fourth input signal; and a second voltage division circuit coupled between the first pull-down circuit and the first output stage.

2. The source driver of claim 1, wherein the output circuit outputs the second and third logic signals each having a third voltage range comprising the first voltage range and the second voltage range by using pull-up elements operating in the first voltage range which is a swing range of the first source signal and pull-down elements operating in the second voltage range which is a swing range of the second source signal.

3. The source driver of claim 2, wherein:

the output circuit operates in the third voltage range.

4. The source driver of claim 1, wherein the output circuit comprises:

a first output circuit configured to output the second logic signal by pull-up or pull-down operating based on logic levels of the second input signal and the fourth input signal; and a second output circuit configured to output the third logic signal by pull-up or pull-down operating based on logic levels of the first input signal and the third input signal.

5. The source driver of claim 4, wherein:

the first pull-up circuit comprises first and second PMOS elements coupled in series, and the first and second PMOS elements have a source terminal and a body terminal coupled, and have gate terminals to which the second input signal is applied.

6. The source driver of claim 4, wherein:

the first pull-down circuit comprises first and second NMOS elements coupled in series, and the first and second NMOS elements have a source terminal and a body terminal coupled, and have gate terminals to which the fourth input signal is applied.

7. The source driver of claim 4, wherein:

the first voltage division circuit comprises third and fourth PMOS elements coupled in series, and each of the third and fourth PMOS elements has a source terminal and a body terminal coupled and has a gate terminal to which a ground voltage is applied.

8. The source driver of claim 4, wherein:

the second voltage division circuit comprises third and fourth NMOS elements coupled in series, and each of the third and fourth NMOS elements has a source terminal and a body terminal coupled and has a gate terminal to which a ground voltage is applied.

9. The source driver of claim 4, wherein the second output circuit comprises:

a second pull-up circuit configured to pull-up drive the third logic signal in response to the first input signal;

a third voltage division circuit coupled between the second pull-up circuit and a second output stage from which the third logic signal is output;

a second pull-down circuit configured to pull-down drive the third logic signal in response to the third input signal; and a fourth voltage division circuit coupled between the second pull-down circuit and the second output stage.

10. The source driver of claim 1, further comprising:

a first clamping circuit coupled between the multiplexer and the first pad and configured to clamp, to a first voltage range or a second voltage range, a first output signal output to the first pad; and a second clamping circuit coupled between the multiplexer and the second pad and configured to clamp, to the first voltage range or the second voltage range, a second output signal output to the second pad.

11. The source driver of claim 10, wherein each of the first and second clamping circuits comprises:

first and second diodes coupled in series; and third and fourth diodes coupled in series.

12. A level shift circuit comprising:

a first level shifter configured to output a first input signal and a second input signal by shifting a level of a first logic signal;

a second level shifter configured to output a third input signal and a fourth input signal by shifting the level of the first logic signal; and an output circuit configured to output a second logic signal in response to the second input signal and the fourth input signal and output a third logic signal in response to the first input signal and the third input signal, wherein the output circuit outputs the second and third logic signals each having a third voltage range comprising a first voltage range and a second voltage range by using pull-up elements operating in the first voltage range and pull-down elements operating in the second voltage range, wherein the first level shifter operates in the first voltage range, the second level shifter operates in the second voltage range, and the output circuit further configured to output the second logic signal equivalent to the highest voltage input to the first level shifter and the third logic signal equivalent to the lowest voltages input to the second level shifter, and wherein the first output circuit comprises:

a first pull-up circuit configured to pull-up drive the second logic signal in response to the second input signal;

a first voltage division circuit coupled between the first pull-up circuit and a first output stage from which the second logic signal is output;

a first pull-down circuit configured to pull-down drive the second logic signal in response to the fourth input signal; and a second voltage division circuit coupled between the first pull-down circuit and the first output stage.

13. The level shift circuit of claim 12, wherein:

the output circuit operates in the third voltage range.

14. The level shift circuit of claim 12, wherein the output circuit comprises:

a first output circuit configured to output the second logic signal; and a second output circuit configured to output the third logic signal.

15. The level shift circuit of claim 14, wherein:

the first pull-up circuit comprises first and second PMOS elements coupled in series, and the first and second PMOS elements have a source terminal and a body terminal coupled, and have gate terminals to which the second input signal is applied.

16. The level shift circuit of claim 14, wherein:

the first pull-down circuit comprises first and second NMOS elements coupled in series, and the first and second NMOS elements have a source terminal and a body terminal coupled, and have gate terminals to which the fourth input signal is applied.

17. The level shift circuit of claim 14, wherein:

the first voltage division circuit comprises third and fourth PMOS elements coupled in series, and each of the third and fourth PMOS elements has a source body terminal and a body terminal coupled and has a gate terminal to which a ground voltage is applied.

18. The level shift circuit of claim 14, wherein:

the second voltage division circuit comprises third and fourth NMOS elements coupled in series, and each of the third and fourth NMOS elements has a source body terminal and a body terminal coupled and has a gate terminal to which a ground voltage is applied.

* * * * *